US006716061B2

(12) United States Patent
Pitschi et al.

(10) Patent No.: US 6,716,061 B2
(45) Date of Patent: Apr. 6, 2004

(54) COAXIAL CONNECTOR

(75) Inventors: Franz Pitschi, Rottach-Egern (DE); Rudolf Peschka, Frasdorf (DE); Anton Lorenz Jun, Bruckmühl (DE); Klaus-Dieter Mischerikow, Ronnenberg (DE)

(73) Assignee: Spinner GmbH Elektrotechnische Fabrik, München (DE)

( * ) Notice: Subject to any disclaimer, the term of this patent is extended or adjusted under 35 U.S.C. 154(b) by 166 days.

(21) Appl. No.: 09/825,678

(22) Filed: Apr. 4, 2001

(65) Prior Publication Data

US 2001/0028289 A1 Oct. 11, 2001

(30) Foreign Application Priority Data

Apr. 7, 2000 (DE) ..... 100 18 595

(51) Int. Cl.[7] ..... H01P 1/04
(52) U.S. Cl. ..... 439/578; 439/585; 333/260
(58) Field of Search ..... 333/260, 245; 439/578, 585, 98, 610

(56) References Cited

U.S. PATENT DOCUMENTS 4,144,404 A * 3/1979 De Groef et al. ..... 333/260 X
5,120,260 A * 6/1992 Jackson ..... 333/260
5,195,910 A 3/1993 Enomoto et al.
5,281,167 A 1/1994 Le et al.
5,547,395 A 8/1996 Delamotte
5,576,675 A * 11/1996 Oldfield ..... 333/260
5,802,710 A 9/1998 Bufanda et al.

FOREIGN PATENT DOCUMENTS

DE 34 03 805 C2 8/1985
DE 42 06 092 C1 7/1993
GB 2 291 285 A 1/1996
GB 2 331 634 A 5/1999

OTHER PUBLICATIONS

US 5,387,128, 2/1995, Hosler, Sr. (withdrawn)

* cited by examiner

*Primary Examiner*—Benny Lee
(74) *Attorney, Agent, or Firm*—Henry M. Feiereisen

(57) ABSTRACT

A coaxial connector includes a connector head housing with a recess adapted to receive, contact and clamp the end of the outer conductor of a coaxial cable. The connector head housing also has an inner conductor for contacting the inner conductor of the coaxial cable. The inner diameter of the recess is equal to the smallest outside diameter of the outer conductor of the respective cable type. Slots disposed in the wall of the recess make the wall resilient in the radial direction. The connector can be connected, in particular soldered, to the outer conductor of coaxial cables both in the factory and at the installation site, even if the coaxial cables have a relatively large diameter. This type of connector provides a particularly low intermodulation.

22 Claims, 9 Drawing Sheets

COAXIAL CONNECTOR

CROSS-REFERENCES TO RELATED APPLICATIONS

This application claims the priority of German Patent Application Serial No. 100 18 595.9, filed Apr. 7, 2000, the subject matter of which is incorporated herein by reference.

BACKGROUND OF THE INVENTION

The present invention relates, in general, to a coaxial cable connector, and more particularly to a coaxial cable connector of a type having a housing with a recess for receiving, contacting and clamping the end of the outer conductor of a coaxial cable, and with an inner conductor in the connector that contacts the inner cable conductor.

As disclosed in DE 42 06 092 C1, a particularly low intermodulation can be achieved by soldering the end section of a connector housing to the outer conductor of the coaxial cable. For soldering, the end section of the connector housing is positioned on the end of the outer conductor of the cable and heated, for example, heated tongs surrounding the end section of the connector housing or through induction. The solder in the form of a solder wire is supplied manually through bores in the end section of the connector housing into the gap between the inner wall of the recess of the end section of the connector housing and the outer conductor of the cable. This installation method for the connector on the cable requires special tools and considerable experience and can only be successfully done in the factory with cables having a maximum diameter of 13 mm (½"). This makes it almost impossible to attain a connection with a low intermodulation by mechanically contacting and clamping at least the outer conductor of the cable in the field, i.e., during installation by the user and at the installation site.

For example, increasingly cables with a particularly low attenuation are required for mobile radio communications, in particular for connecting a mobile radio base station with a remote antenna installation. These cables can have an outer diameter of more than 60 mm and are for practical reasons typically fitted with the necessary connectors only at the installation site. With these connectors, at least the outer conductor of the cable is mechanically clamped in the end section of the connector housing. This process is not suitable for providing connections with low intermodulation. However, the marketplace increasingly requires field-installable connectors for even thicker cables which provide adequate intermodulation performance.

It would therefore be desirable and advantageous to provide an improved coaxial connector, which can be soldered in the factory as well as at the installation site, even for large-diameter coaxial cables for providing an optimal connection with low intermodulation.

SUMMARY OF THE INVENTION

According to one aspect of the invention, the inner diameter of the recess is identical to the smallest outer diameter of the outer conductor of the respective cable type and the wall of the recess has slots so as to be elastic in the radial direction.

Advantageously, the slots can extend parallel to an axial direction of the connector housing. The elastic segments in the portion of the connector housing which receives the end of the outer conductor compensate any tolerances in the diameter as well as deviations from the roundness of the outer conductor of the cable, which can be significant in particular when the outer conductors are corrugated. The various segments of the wall of the recess thereby contacts the outer conductor of the cable. Heat is then transmitted rapidly and uniformly from the wall of the end section of the connector housing to the outer conductor of the cable, and the supplied or existing solder melts quickly and essentially uniformly, with capillary action distributing the solder uniformly across the entire surface of the solder gap.

According to another feature of the present invention, a solder wire including flux agent is disposed on the wall of the recess in at least in the region of the nominal position of the front edge of the outer conductor of the cable. In this way, for cables with a smooth outer conductor as well as for cables with an annular or helical corrugated outer conductor, an amount of solder sufficient for filling the solder gap is provided and uniformly distributed along the circumference before the solder begins to melt. The soldering operation is thereby accomplished quickly without melting the dielectric of the cable.

If an inner conductor of the connector is to be soldered to the inner cable conductor, then the cable end is prepared for installation by having the inner cable conductor protrude over the end of the outer conductor of the cable by a distance that is equal to approximately two diameters of the inner conductor. in this way, the connection between the inner connector conductor and the inner cable conductor is established first. Subsequently, the end section of the connector housing is pushed over the cable, including the inner conductor of the connector, and subsequently heated to solder the end section of the connector housing to the outer conductor of the cable.

According to another feature of the present invention, the wall thickness of the wall recess at least in the receiving area of the outer conductor of the cable may be less than in the remaining region of the end section of the connector housing. This reduces the heat capacity of the end section of the connector housing in the area that is to be soldered, so that less heat has to be supplied and the solder operation takes less time.

Advantageously, the solder reservoir (reservoirs) is (are) disposed in a circumferential groove provided in the wall of the recess. This keeps the solder reservoir in place before the soldering operation and permits a smaller. the solder gap. Typically, two solder reservoirs that are separated in the axial direction are sufficient.

Suitably, round or slot-like recesses can be distributed along the circumference of the wall to allow visual observation of the solder process. The number and location of the recesses can be selected according to the circumference of the cable.

According to another feature of the present invention, the width of the slots can be so dimensioned that the solder flows into the slots through capillary action, independent of the exact position of the connector during soldering. The solder fills the slots uniformly after the soldering operation, so that connection between the end section of the connector housing and the outer conductor of the cable is sealed, both mechanically and against HF leakage.

According to another feature of the present invention, at least one additional solder reservoir can be disposed outside the wall of the recess at the height of the slots. The additional solder reservoir can have the form, for example, of an axial recess located in an annular shoulder of the wall that is filled with solder. The additional solder reservoir is recommended when the slots, which are located in the wall to provide sufficient radial elasticity, extend from the end section of the connector housing facing the cable a certain distance beyond the edge of the outer conductor of the cable towards the connector side. With this additional solder reservoir, even the region near the end portions of the slots will be completely filled with solder after the soldering operation.

According to another feature of the present invention, the wall can be surrounded by a solderable sleeve at least over a portion of the length of the slotted region. The sleeve is preferably located in a region of the end section of the connector housing that is located on the connector side of the front edge of the outer conductor of the cable. The sleeve increases the mechanical rigidity, in particular the bending stiffness, of the thin-walled region of the end section of the connector housing after the soldering operation, which functions as strained relief for the cable, absorbing tensile and bending forces. As mentioned above, the wall is kept thin to reduce the heat capacity. Depending on the diameter in this region, this sleeve can be slotted and snapped on or can be made of, for example, two suitably attached half shells. The quality of the solder joint can be inspected visually, if the sleeve leaves at least short sections of the slots unobstructed on the side of the connector and the cable.

The sleeve can be pressed onto the end section of the connector housing in a defined position, wherein the sleeve covers the slots in the wall at least over a portion of its axial extent, while still permitting the segments of the wall on the end section of the connector housing to become resiliently biased when the housing is pushed onto the outer conductor.

According to another feature of the present invention, the sleeve can contact a solder reservoir disposed in an outside annular ridge of the wall of the end section of the connector housing. The annular ridge defines the position of the sleeve.

Moreover, the sleeve can be non-positively connected with, in particular screwed on, the end section of the connector housing. The non-positive connection can be, for example, an outside thread formed on the end section of the connector housing engaging with an inner thread formed in the sleeve. The region with the non-positive connection need not be located in the same region of the end section of the connector housing where the outer conductor of the cable is soldered and the remaining regions of the slots on the cable side are filled. This sleeve can form the mechanical outer jacket of the end section of the connector housing and can also extend into the region of the connection plane. The sleeve can have an outside thread adapted to engage with a coupling ring of the mating connector. The sleeve also transmits tensile and compression forces acting on the cable and the connector.

At least at the height of the end portions of the slots, the sleeve can have a ring-shaped inner groove for receiving a solder reservoir. In this way, the slots in the wall of the recesses and the annular gap between the sleeve and the wall of the recess are completely filled with solder during the soldering operation. If the side of the sleeve facing the connector does not significantly protrude over the end portions of the slots and if the end face of the sleeve facing the connector is chamfered, then the flow of solder into the chamfer during the soldering operation due to the capillary action is indicative of a successfully completed soldering operation.

Each of the solder reservoirs or an additional solder reservoir can be provided as a solder foil between the surfaces to be soldered. The solder foil can also be located between the outer conductor of the cable and the corresponding inner wall section of the recess and/or between the wall of the end section of the connector housing and the sleeve.

Suitably, at least the inside of the wall of the recess can be wetted with a flux.

According to another feature of the present invention, at least the regions of the wall to be soldered, and more particularly the entire current-carrying surfaces of the end section of the connector housing, can be silver-plated.

In an embodiment of a connector adapted for helically corrugated cables, the wall of the recess can also be at least partially helical to complement the profile of the outer conductor of the cable, with at least one of the solder reservoirs conforming to the helical structure over at least a portion of its length. The other solder reservoirs can be ring-shaped, as for cables with smooth or helical outer conductors.

To further improve the intermodulation performance, the inner conductor of a connector can be adapted so that it can be soldered to the inner cable conductor.

In particular, the inner conductor of cables with a large diameter can be formed as smooth, ring-like or helical corrugated tube. In this case, the inner conductor of the connector can have slots that are elastic in the radial direction, with the inner conductor having least one solder reservoir to facilitate soldering. Providing the inner conductor of the connector with slots serves the same purpose as making the wall of the recess of the end section of the connector housing elastic in the radial direction. In this way, tolerances and roundness errors of the inner cable conductor can be compensated, while heat is transferred efficiently and rapidly from the inner cable conductor positioned on the outside—through which heat is supplied—to the inner conductor of the connector positioned on the inside.

Advantageously, the solder reservoir is made of ring-shaped solder wire including flux.

According to another embodiment, the wall of the end section of the connector housing can have openings through which molten solder can be supplied to the circumferential gap located between the outer conductor of the cable and the inner wall of the recess. The solder operation can also be visually monitored through these openings, wherein the number and location of the openings depend on the girth of the cable.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

The invention is directed to a coaxial cable connector that can be soldered in the field to a larger diameter coaxial cable and has a low intermodulation.

Figure 1:
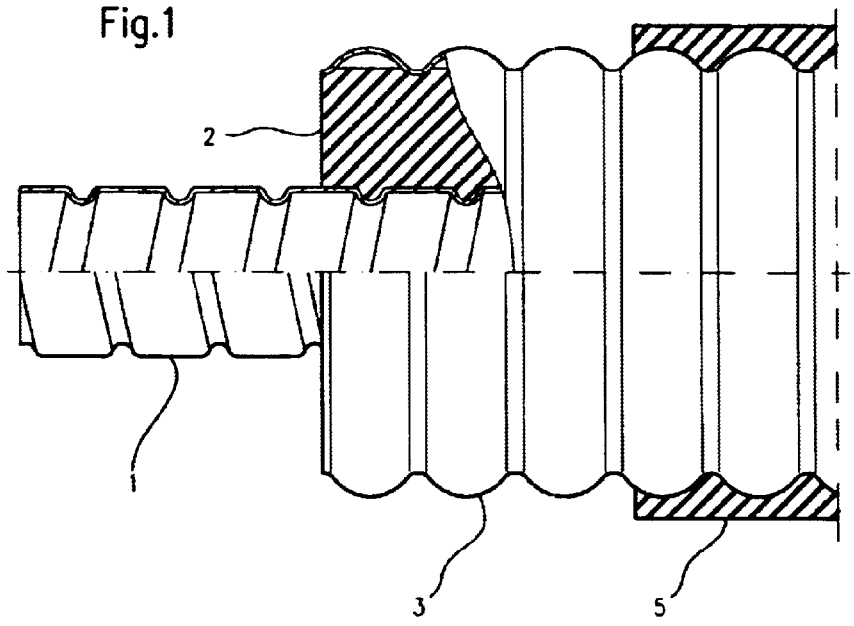
FIG. 1 is a partially sectional illustration of an end portion of a coaxial cable adapted for soldering to a connector according to the present invention.
Figure 2:
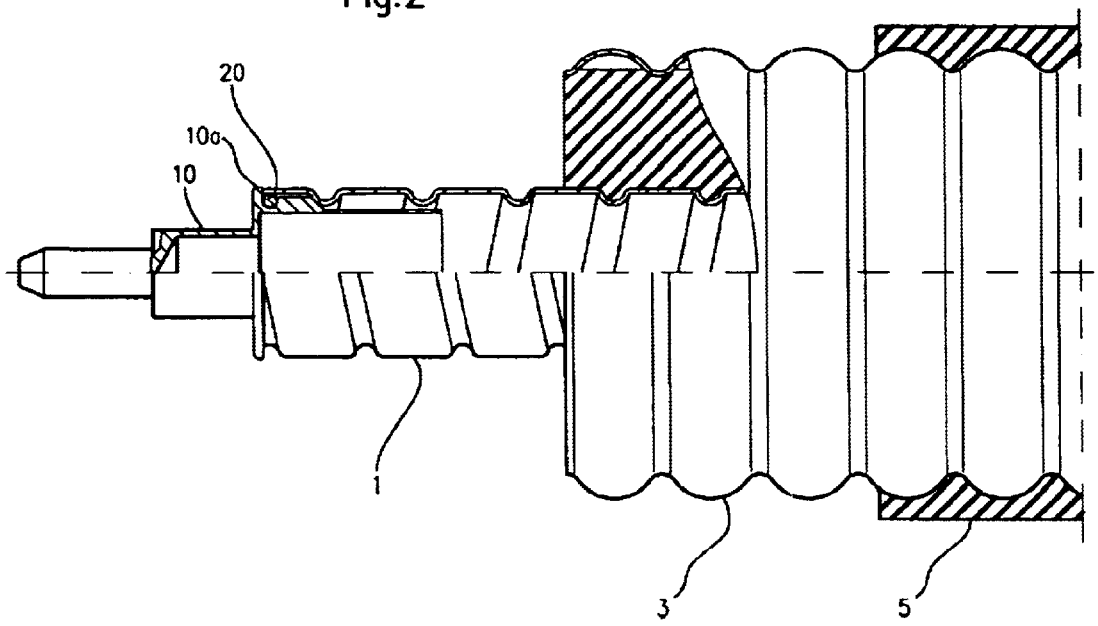
FIG. 2 is a partially sectional illustration of the coaxial cable after soldering the inner cable conductor to the inner connector conductor.
Figure 7:
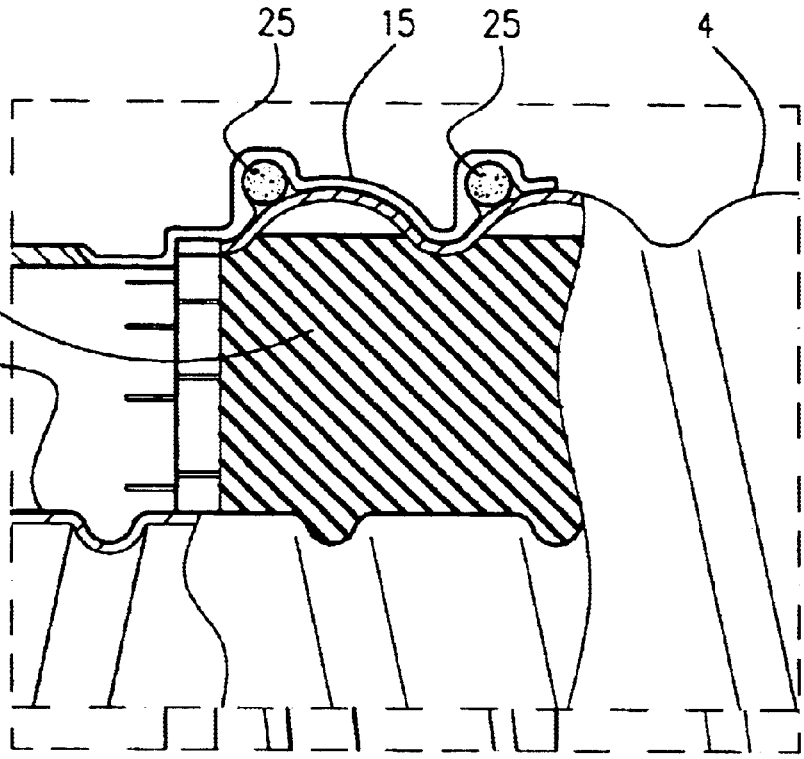
FIG. 7 is a partial sectional view of a fourth embodiment of a connector according to the present invention, before soldering.
Figure 8:
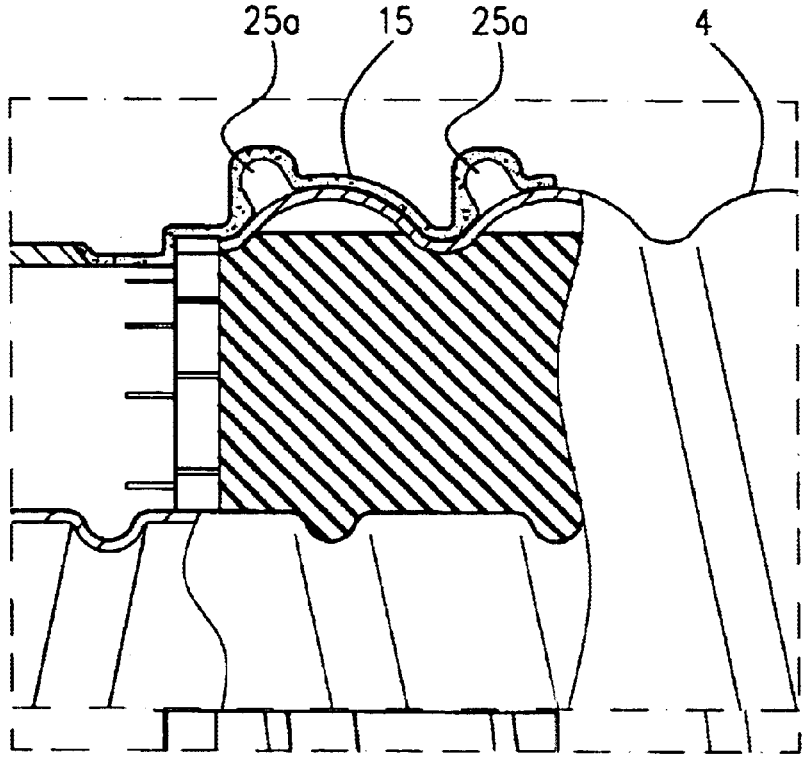
FIG. 8 is a partial sectional view of the connector of FIG. 7, after being soldered.

Turning now to the drawing, and in particular to FIG. 1, there is shown a coaxial cable with a tubular inner conductor 1 which can be corrugated and formed as a helix; a dielectric 2 which frequently consists of an expanded foam with a low melting point; an annularly corrugated outer conductor 3 or alternatively, a helically corrugated outer conductor 4, as depicted in FIGS. 7 and 8; a cable jacket 5; and an inner conductor 10 of the connector which can be formed as a pin and or a jack on the side facing the plugs as depicted in FIG. 2. Both the inner conductor and the outer conductor of the coaxial cable can be soldered to a connector according to the invention. For this purpose, the dielectric 2 and the outer conductor of the cable 3 are recessed with respect to the inner cable conductor 1 by a distance equal to approximately twice the diameter of the inner conductor 1 and cut approximately at the height of a valley of the ring-shaped corrugation. The cable jacket 5 is recessed even further.

Referring now to FIG. 2, the outer profile of the inner conductor 10 of the connector which is complementary to the helical corrugation of the inner cable conductor 1, is screwed into the inner conductor 1 until it reaches a stop of a ring-shaped collar 10*a* disposed on the front edge of the inner cable conductor 1. On the side of the ring-shaped collar 10*a* facing the cable, the inner conductor 10 of the connector has an annular groove in which a solder wire 20 is inserted. The depth of the annular groove is approximately equal to or somewhat smaller than the diameter of solder wire 20. The solder wire 20 therefore contacts the inner wall of the inner conductor 1 of the tubular cable. The solder wire 20 melts when the inner cable conductor 1 is heated with an external heat source, and the solder flows at least in the front section of the inner cable conductor 1 into the gap between the inner conductor 1 and the portion of the inner conductor 10 of the connector that is surrounded by the inner cable conductor 1.

Figure 3:
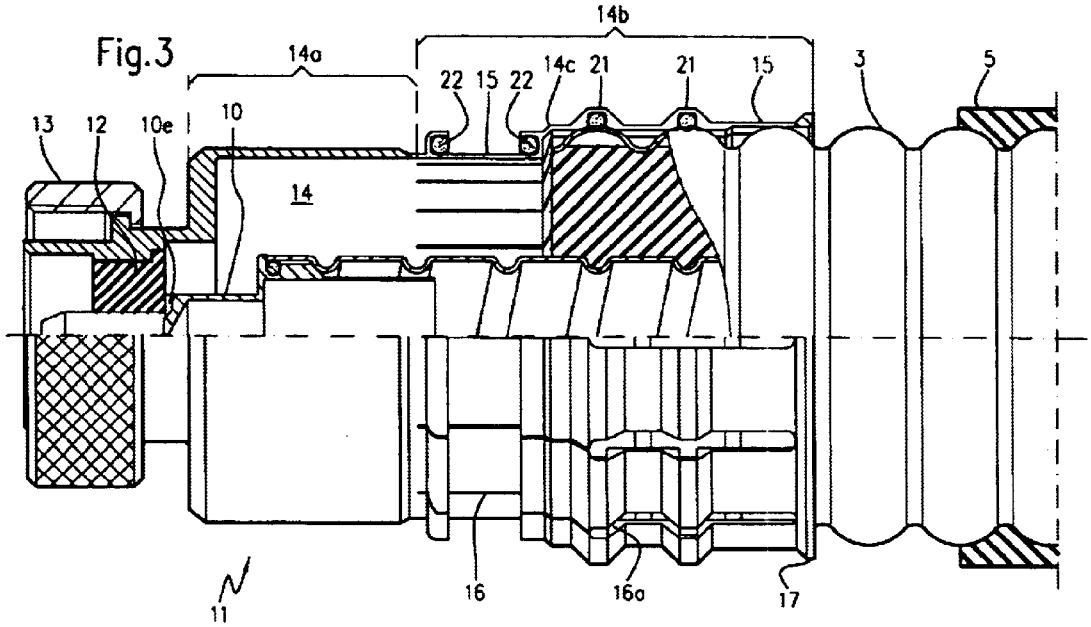
FIG. 3 is an illustration of a first embodiment of a connector according to the present invention, with the upper half shown as a longitudinal sectional view and the lower half shown as a side view on the end of the coaxial cable before soldering.

Referring now to FIG. 3, the end section of the connector housing 11 is then pushed onto the outer conductor of the cable 3 until a step 10*e* formed on the inner conductor 10 of the connector contacts an insulating support 12 which supports the inner conductor 10 of the connector. These components and a threaded sleeve 13 are known in the art and are of no further interest for the present invention. On the cable side of the insulating support 12, the end section of the connector housing 11 has an recess adapted to receive the end portion of the coaxial cable. A first region 14*a* of the recess has a relatively thick wall to provide mechanical stability. Adjacent to the region 14*a* is a second, significantly thinner wall region 14*b* with a stepped diameter at 14*c* to prevent a discontinuity in the characteristic impedance. The wall 15 of a thin-wall region 14*b* of the recess 14 has several slots 16 which originate at a front edge 17 facing the cable side of the end section of the connector housing 11. To provide rigidity, the front edge is continuous. The slots 16 extend in the axial direction to the beginning of the thick-wall region 14*a*. The width of the slots 16 increases in the region 16*a*, where the slots 16 cover the outer conductor of the cable 3. Optionally, only every other slot may have an increased slot width. In region 16*a*, two annular grooves are machined on the inside of the wall 15 with an axial spacing equal to the distance between peaks of the corrugation of the outer conductor of the cable 3. Each of the annular grooves holds a solder wire ring 21. Facing the plug side from the diameter step at 14*c*, the wall 15 has two axially spaced annular shoulders, each having an axial groove adapted to receive an additional solder wire ring 22. The inner diameter of the recess 14 facing the cable side of the diameter step 14*c* is selected so that the solder wire rings 21 which have identical axial spacing, contact the crests of the corrugation over the entire circumference at least approximately, even if the outside diameter of the outer conductor of the cable 3 is at the lower tolerance limit. The slots 16 which are elastic in the radial direction provide a sufficiently resilient contact between the wall 15 and the outer conductor of the cable 3 in situations where the outer conductor of the cable is not circular or has a diameter at the upper tolerance limit. At least the wall 15 can be made of a suitable springy material, such as brass or bronze with a copper base.

When the end section of the connector housing 11 is heated in the region 14*b*, for example with a solder torch, the thin wall section of the wall 15 causes the solder wire rings 21 and 22 to melt rapidly. The molten solder completely fills the gaps and the narrow sections of the slots on the connector side before and in the region of the diameter step 14*c* due to capillary action and an excellent heat transfer to the outer conductor of the cable 3. Melting of the solder in the expanded regions 16*a* of the slots 16 can be conveniently observed and controlled in the region of the solder wire rings 21. The solder wire rings 22, on the other hand, fill and close the sections of the slots 16 facing the plug side before the diameter step 14*c*, thereby sealing this region against HF leakage. A heat-shrinkable sleeve which at least covers the soldered region can be installed to prevent humidity and the like from entering the recess 14.

Figure 4:
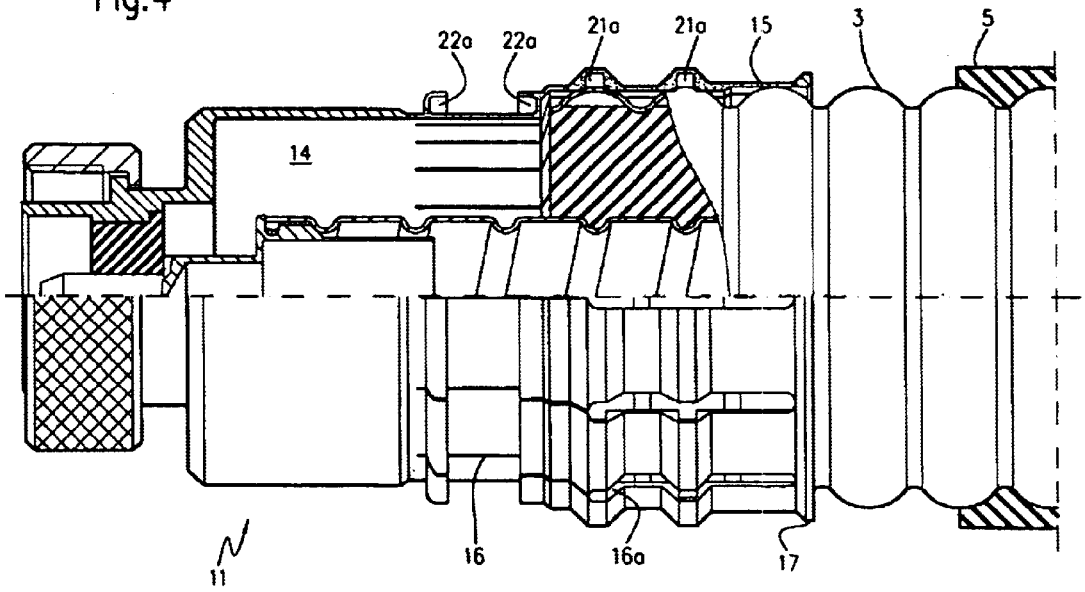
FIG. 4 is a partially sectional illustration of the connector of FIG. 3 after being soldered.

FIG. 4 shows the status after soldering. The annular interior grooves in the wall 15 have the reference numeral 21*a* and the annular exterior shoulders have the reference numeral 22*a*.

Figure 5:
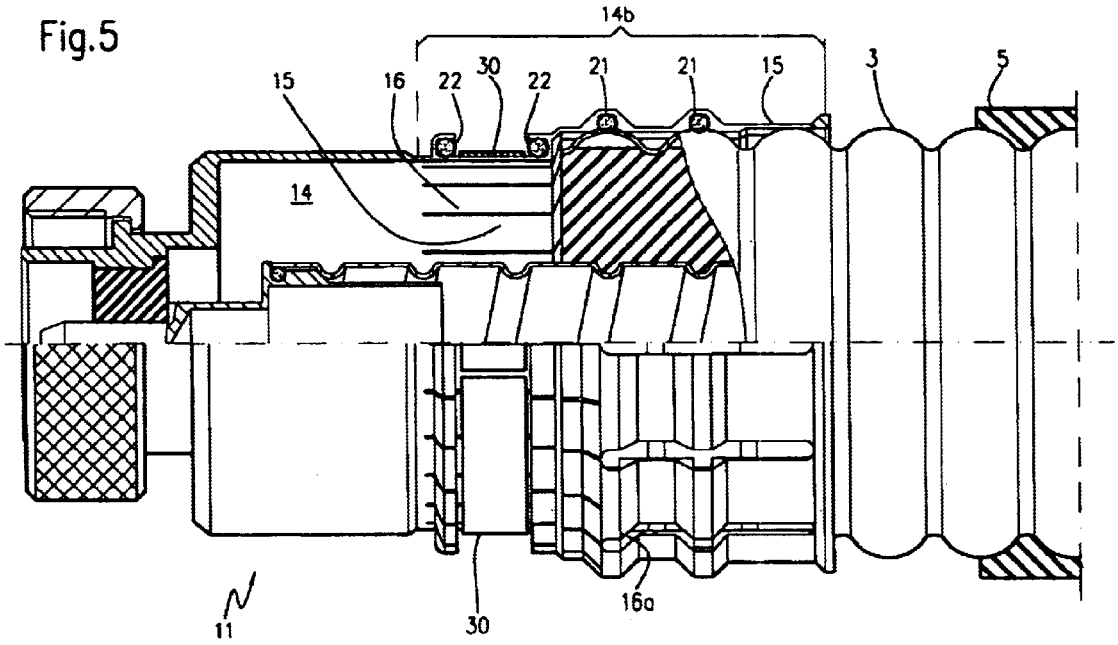
FIG. 5 is a partially sectional illustration of a second embodiment of a connector according to the present invention, disposed on the end of the coaxial cable before soldering.

Unlike the embodiment of FIGS. 3 and 4, the embodiment depicted in FIG. 5 has a slotted sleeve 30 disposed and/or snapped on between the annular shoulders of the wall 15 which received the solder wire rings 22. The sleeve 30 which is soldered to the wall 15 after melting the solder wire rings 22, significantly increases the rigidity of the plug connector in the thin-wall region and guarantees HF leak tightness.

Figure 6:
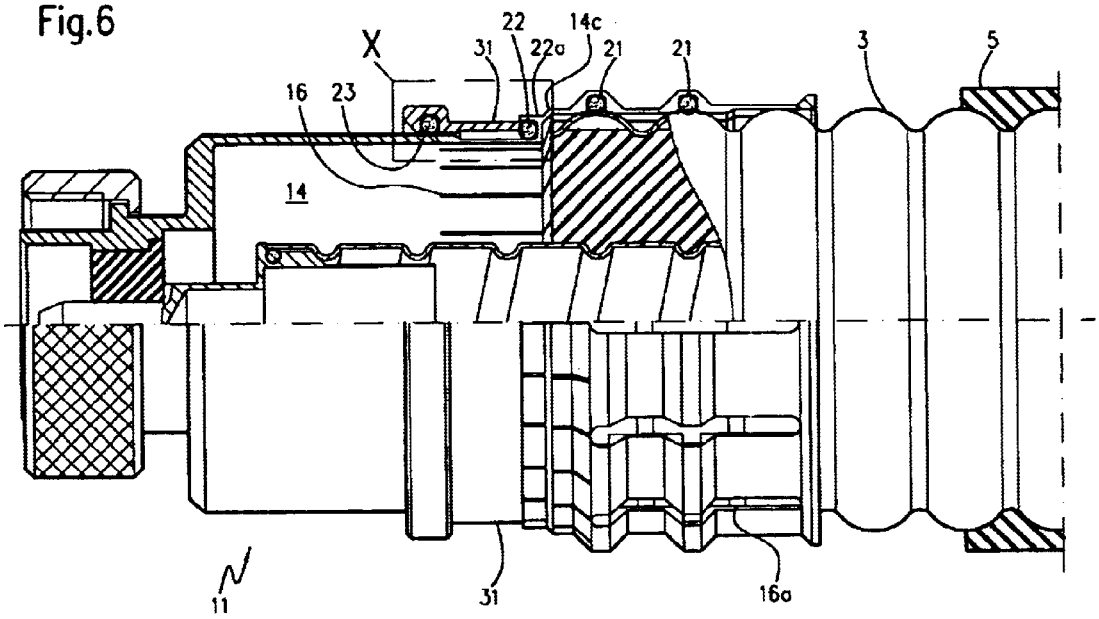
FIG. 6 is a partially sectional illustration of a third embodiment of a connector according to the present invention, before soldering.

Unlike the embodiment of FIG. 5, the embodiment depicted in FIG. 6 has on the side of the diameter step 14*c* facing the plug only one annular shoulder 22*a* adapted to receive a solder wire ring 22. A sleeve 31 which has an inside groove for a solder wire ring 23 disposed on the front end region facing the cable, is pressed onto the end section of the connector housing from the plug side. The front edge of the sleeve 31 facing the cable holds the solder wire ring 22 in the groove of the ring shoulder 22*a*.

Figure 6A:
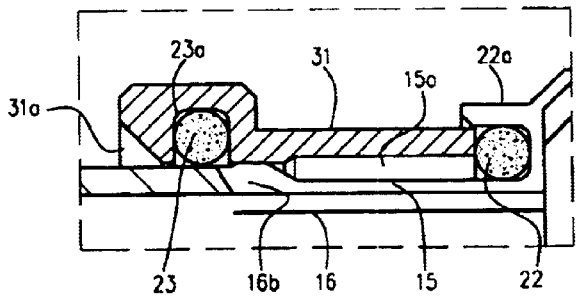
FIG. 6*a* is a cutaway view of a region marked X in FIG. 6 before soldering.

As depicted in FIG. 6*a*, the inner groove of the sleeve 31 partially overlaps the root area 16*b* of the slots 16, so that the molten solder can flow into and completely fill the slots, if the slots are not already filled by the molten solder supplied by the solder wire ring 22. A circumferential gap 15*a* remains between the inner wall of sleeve 31 and the wall 15. In this way, the sleeve does not obstruct the resilient action of the slots 16 forming the wall 15 when the end section of the connector housing is pushed onto the outer conductor of the cable.

Figure 6B:
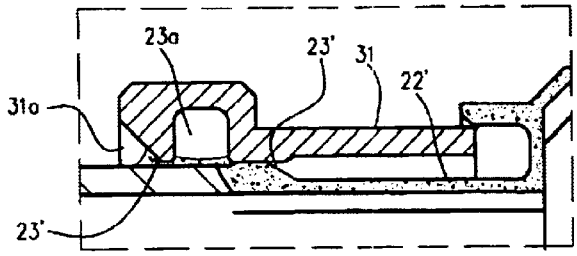
FIG. 6*b* shows the region X in FIG. 6 after soldering.

FIG. 6*b* shows the situation after soldering. The molten and re-solidified solder has the reference numerals 22' and 23', respectively.

As also shown in FIGS. 6*a* and 6*b*, the sleeve 31 has a chamfer 31 a disposed on its front edge facing the plug. The molten solder enters the chamfer through a capillary gap that is formed between the annular grooves 23*a* with the solder wire ring 23 (see FIG. 6*a*) and the chamfer 31*a*. The installer has then the opportunity to visually monitor the progress and result of the solder operation.

FIG. 6*a* also shows that the depth of the annular groove 23*a* is identical to or slightly smaller than the diameter of the solder wire ring 23, providing a metallic contact between the solder wire ring 23 and the wall 15 and an excellent heat transfer.

Figure 6C:
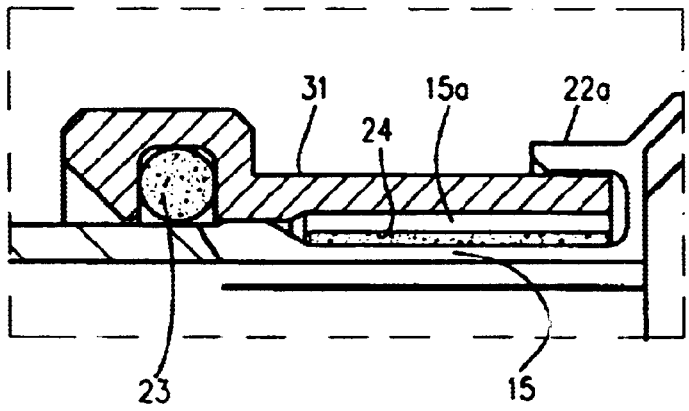
FIG. 6*c* is a sectional view of a variation of the region X in FIG. 6.

FIG. 6*c* shows a somewhat different embodiment from that of FIG. 6, wherein a solder foil 24 which is arranged in the circumferential gap 15*a* between the sleeve 31 and the wall 15 is used instead of the solder wire ring 22.

FIGS. 7 and 8 show a partial sectional view of another embodiment of a connector adapted for installation on a coaxial cable with a helically corrugated outer conductor 4. Accordingly, the wall 15 has a helical profile which has a helical corrugation that matches the corrugation of the outer % conductor of the cable 4. The solder reservoirs on the inside of the wall 15 are implemented as solder wire rings 25 (see FIG. 7) received in grooves 25*a* (see FIG. 8). The solder reservoirs extend along the helical corrugation so as to contact the entire circumference of the outer conductor of the cable 4 at at least one location, so that the outer conductor of the cable 4 is completely soldered two-dimensionally to the wall 15 after the solder reservoir melts. This situation is depicted in FIG. 8.

Figure 9:
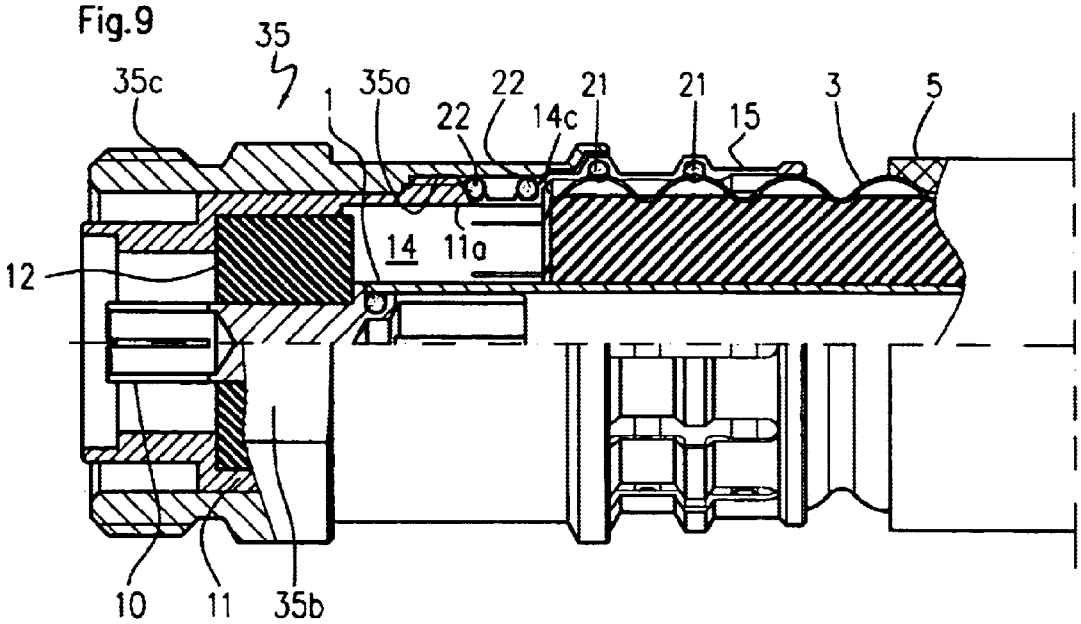
FIG. 9 is an illustration of a fifth embodiment of a connector according to the present invention, with the upper half shown as a longitudinal sectional view and the lower half shown as a side view on the end of the coaxial cable before soldering.

FIG. 9 shows another embodiment which is suitable in particular for connectors that have a larger diameter at their plug or socket end than the diameter of the end section of the connector housing in a region of the solder reservoir 21.

Similar to the embodiment of FIG. 6, the end section of the connector housing 11 has a sleeve 35 which is pushed on the end section of the connector housing 11 from the plug side. The sleeve 35 is non-positively connected via an interior thread section 35*a* with a mating outer thread section 11*a* disposed on the end section of the connector housing. The sleeve 35 projects over the diameter step 14*c* into the region where the wall 15 is soldered to the outer conductor 3 of the cable. On the side of the thread-engaging region facing the plug, the sleeve 35 has an annular shoulder 35*b* with keyed surfaces. An outer thread region 35*c* is located on the sleeve 36 facing the plug or socket side and adapted to threadingly engage with a sleeve of a mating connector (not shown). The sleeve 35 hereby simultaneously forms the mechanical outer jacket of the conductor housing 11.

Figure 10:
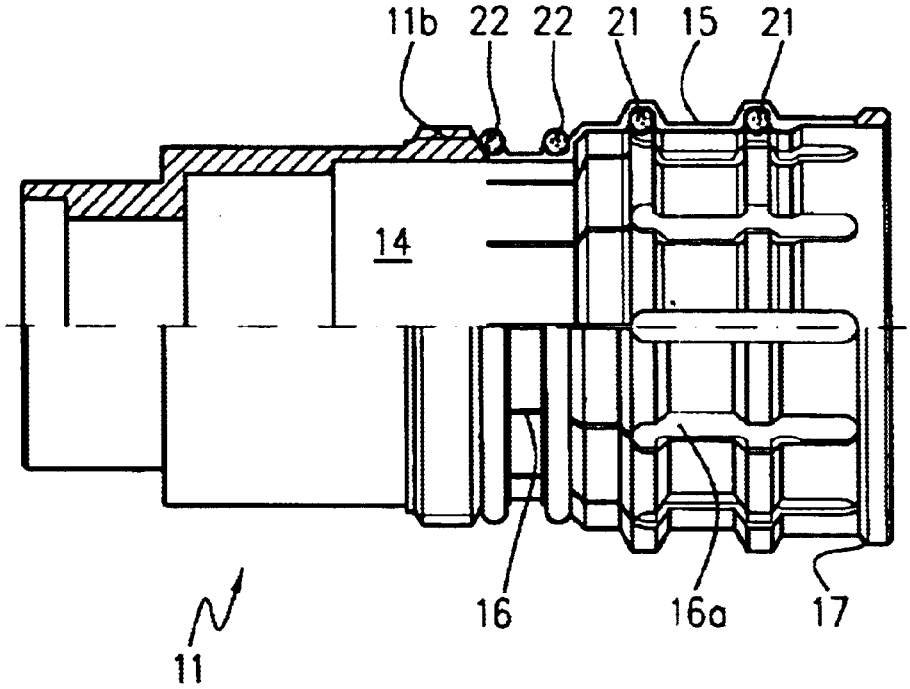
FIG. 10 is a schematic illustration of the end section of the connector housing of the connector of FIG. 9.

FIG. 10 shows only the end section of the connector housing 11 of the afore-described embodiment of FIG. 9 with solder reservoirs in the form of solder wire rings 21 and 22. Annular shoulders in the wall 15 (similar to those depicted in FIGS. 3 and 4) can be eliminated, since the solder wire rings 21 and 22 are held in place by the sleeve 35 until the solder operation takes place.

Figure 11:
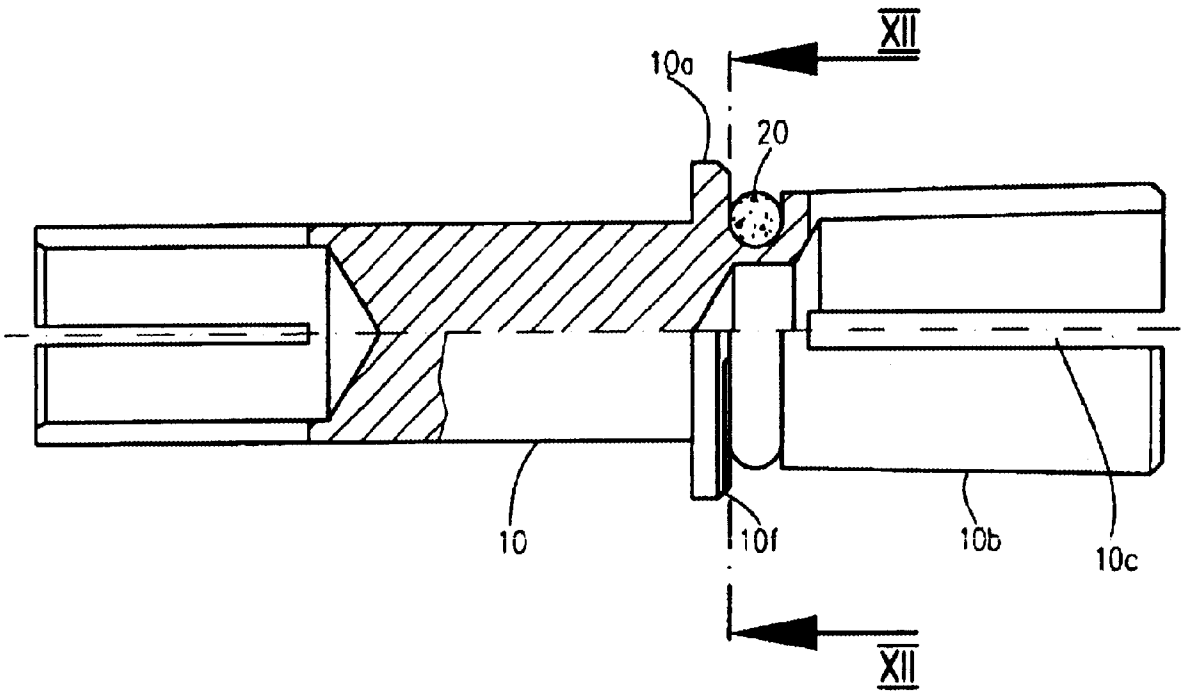
FIG. 11 is an illustration of an inner connector conductor, partially as a side view, and partially as a longitudinal sectional view.
Figure 12:
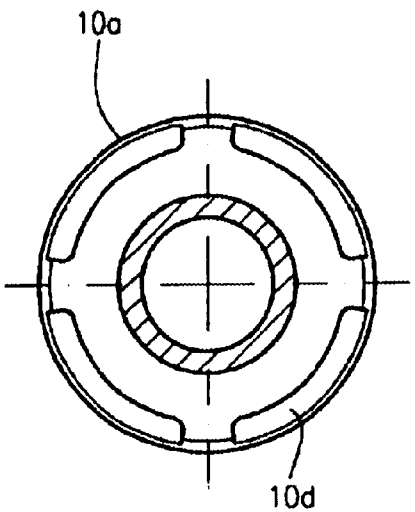
FIG. 12 is a cross-sectional view of the inner connector conductor, taken along the line XII—XII of FIG. 11.

FIGS. 11 and 12 depict in an enlarged scale an exemplary inner conductor 10 of a connector (see also FIG. 2), which can be inserted into, for example, a smooth-walled hollow inner cable conductor (not shown). The section 10*b* (see FIG. 11) of the inner conductor 10, which engages with the inner cable conductor, has axial slots 10*c*, rendering the section 10*b* elastic in a radial direction, thereby providing an excellent heat transfer to the inner cable conductor and hence also to the solder reservoir 20 implemented as a solder wire ring. The annular shoulder 10*a* is discontinuous with recesses 10*d* (see FIG. 12), which facilitate observation of the solder operation, whereby a portion of the molten solder can egress into the circumferential facet 10*f*.

While the invention has been illustrated and described as embodied in a coaxial connector, it is not intended to be limited to the details shown since various modifications and structural changes may be made without departing in any way from the spirit of the present invention.

What is claimed as new and desired to be protected by Letters Patent is set forth in the appended claims:

1. A coaxial connector adapted to be soldered to a coaxial cable, comprising:

a connector header housing with a recess having a wall with slots so as to be elastic in a radial direction, the recess adapted to receive, contact and clamp an end portion of an outer conductor of the coaxial cable, an inner conductor of the connector for contacting an inner conductor of the coaxial cable, and a solder reservoir with solder disposed on an inside surface of the wall of the recess at least in a region of the wall of the recess corresponding to a prescribed position of a front edge of the end portion of the outer conductor of the coaxial cable, wherein an inside diameter of the recess is equal to a smallest outside diameter of the outer conductor of the coaxial cable.

2. The connector of claim 1, wherein the solder reservoir includes a solder wire ring provided with a flux.

3. The connector of claim 1, wherein at least one additional solder reservoir is arranged on an outside surface of the wall of the recess and at a height of the slots.

4. The connector of claim 3, wherein the at least one additional solder reservoir includes a solder wire ring provided with a flux.

5. The connector of claim 1, wherein the solder reservoir is arranged as a circumferential groove disposed in the wall of the recess.

6. The connector of claim 1, wherein at least a first section of the wall of the recess where the end portion of the outer conductor of the coaxial cable is received, has a reduced wall thickness as compared to a remaining section of the wall of the recess.

7. The connector of claim 1, wherein a width of the slots is selected so that capillary action causes the solder to flow from the solder reservoir into the slots independent of an orientation of the coaxial connector.

8. The connector of claim 1, wherein the solder reservoir comprises a solder foil and disposed on a surface of the wall of the recess facing the end portion of the outer conductor of the coaxial cable.

9. The connector of claim 1, wherein at least a portion of a length of the slots is surrounded by a sleeve adapted to be soldered to the wall of the recess.

10. The connector of claim 9, wherein the sleeve is pressed on the connector header housing in a predefined position so as to cover the slots in the wall of the recess at least over a portion of the length of the slots.

11. The connector of claim 9, wherein a further solder reservoir is disposed in an outside annular shoulder of the wall of the recess and the sleeve contacts the further solder reservoir.

12. The connector of claim 11, wherein the further solder reservoir includes a solder wire ring provided with a flux.

13. The connector of claim 9, wherein the sleeve has a ring-shaped inner groove located at least at a height corresponding to a height of end portions of the slots and adapted to receive an additional solder reservoir.

14. The connector of claim 9, wherein the sleeve is non-positively connected with the connector header housing.

15. The connector of claim 14, wherein the sleeve is screwed onto the connector header housing.

16. The connector of claim 1, wherein at least an inside surface of the wall of the recess is wetted with a flux.

17. The connector of claim 1, wherein at least a region of the wall of the recess that is to be soldered, is silver-plated.

18. The connector of claim 1, wherein the outer conductor of the coaxial cable is helically corrugated, with the wall of the recess being defined by a helical profile that is at least partially complementary to the helically corrugated profile of the outer conductor of the coaxial cable, and wherein the solder reservoir extends over at least a portion of a length of the helical wall profile.

19. The connector of claim 1, wherein the inner conductor of the connector is adapted to be soldered to the inner conductor of the coaxial cable.

20. The connector of claim 19, wherein the inner conductor of the connector includes slots so as to be elastically deformable in the radial direction and at least one inner solder reservoir for soldering the inner conductor of the connector to the inner conductor of the coaxial cable.

21. The connector of claim 20, wherein the at least one inner solder reservoir includes a solder wire ring provided with a flux.

22. A coaxial connector adapted to be soldered to a coaxial cable, comprising:

a connector head housing with a recess having a wall with slots so as to be elastic in a radial direction, the recess adapted to receive an end portion of an outer conductor of the coaxial cable and having an inside diameter that is equal to a smallest outside diameter of the outer conductor of the coaxial cable, an inner conductor of the connector for contacting an inner conductor of the coaxial cable, wherein the wall of the recess includes openings distributed about a circumference of the wall of the recess for visually monitoring a soldering operation between the coaxial connector and the coaxial cable.

* * * * *